US005143228A

United States Patent [19]

Arnold

[11] Patent Number: 5,143,228

[45] Date of Patent: Sep. 1, 1992

[54] GARDEN EQUIPMENT SUPPORT RACK

[75] Inventor: William D. Arnold, Florissant, Mo.

[73] Assignee: Lee/Rowan Company, St. Louis, Mo.

[21] Appl. No.: 859,090

[22] Filed: Mar. 27, 1992

[51] Int. Cl.[5] ..... A47F 5/00

[52] U.S. Cl. ..... 211/70.6; 211/88; 211/106

[58] Field of Search ..... 211/70.6, 88, 106, 65, 211/66

[56] References Cited

U.S. PATENT DOCUMENTS

| | | | |
|---|---|---|---|
| 2,923,415 | 2/1960 | Brown | 211/88 X |
| 4,004,526 | 1/1977 | King | 211/106 X |
| 4,234,094 | 11/1980 | Jorgensen | 211/106 X |
| 4,467,925 | 8/1984 | Ratzloff et al. | 211/70.6 |
| 4,655,351 | 4/1987 | Walker | 211/88 |
| 4,723,663 | 2/1988 | Learn | 211/70.6 X |

FOREIGN PATENT DOCUMENTS

| | | | |
|---|---|---|---|
| 1102977 | 2/1968 | United Kingdom | 211/106 |

*Primary Examiner*—Robert W. Gibson, Jr.

*Attorney, Agent, or Firm*—Rogers, Howell & Haferkamp

[57] ABSTRACT

A garden equipment support rack has a fixed frame in combination with a removable basket. The fixed frame has a first single wire element that is bent to form a basket support rack. The basket has a front, a back, and two opposite side walls. At the upper edges of the side walls, there is a continuous peripheral wire that functions as a flange portion by which the basket is removably supported on the basket support rack. The basket is for containing such assorted things as trowels, garden gloves, small pots, packets of seed and fertilizer, and so on, and is easily freed from the basket support rack for transport. The fixed frame also has several wire elements that are bent and arranged to form a pair of garden tool support assemblies. Each garden tool support assembly can removably support one or several garden tools. The form of the fixed frame generally permits it to nest with additional fixed frames, thereby reducing shipping costs and permitting a greater number of fixed frames to be stocked in inventory and displayed on store shelves.

18 Claims, 2 Drawing Sheets

FIG. 1.
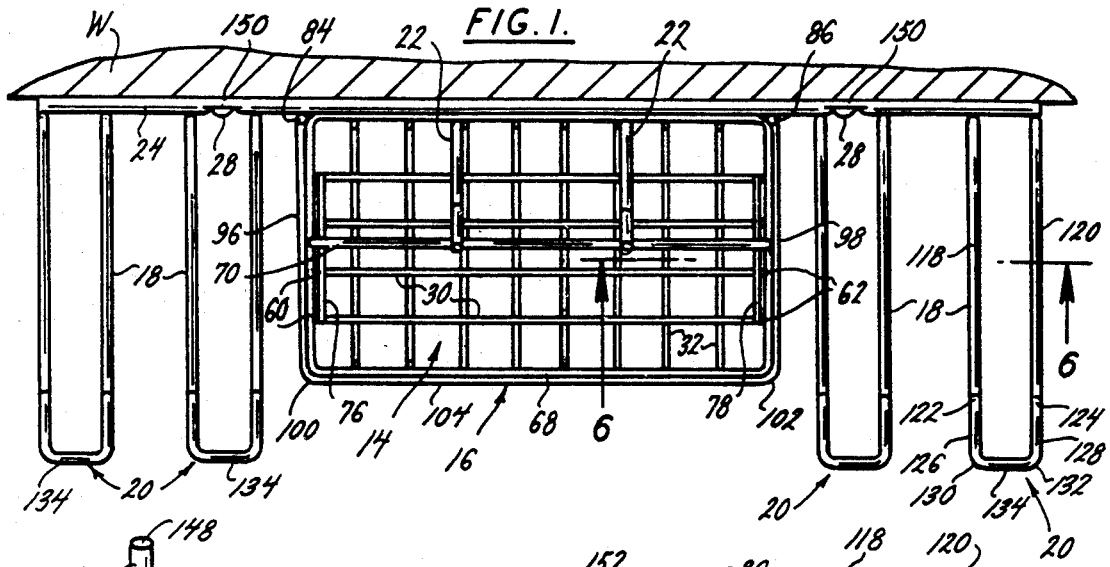
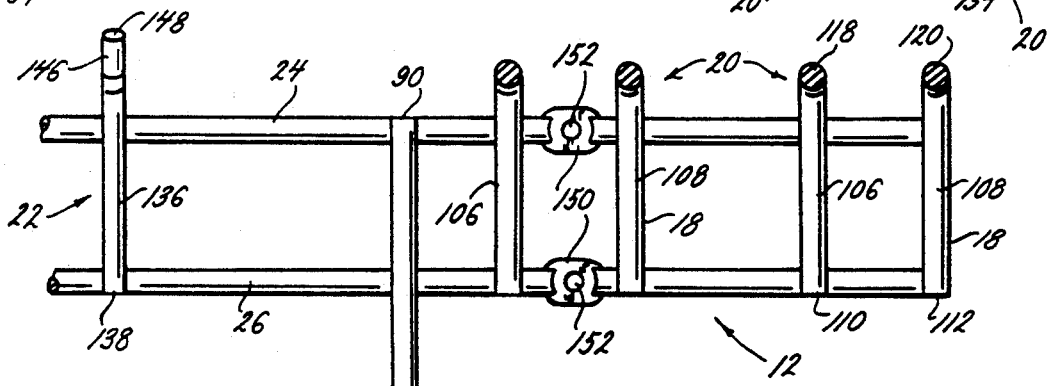
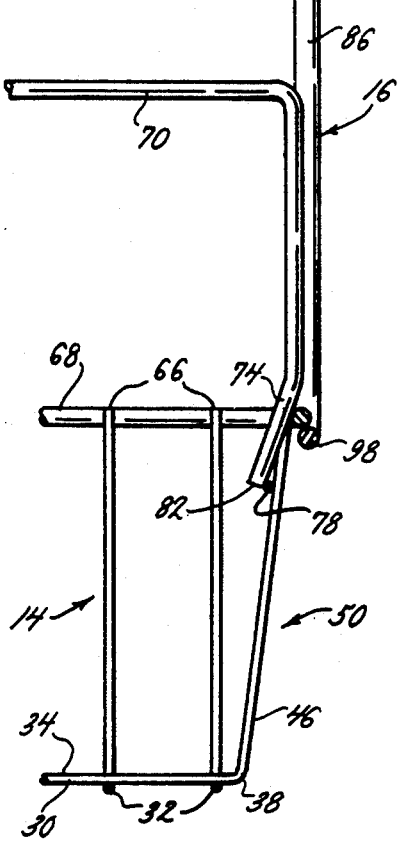
FIG. 6.

FIG. 2.
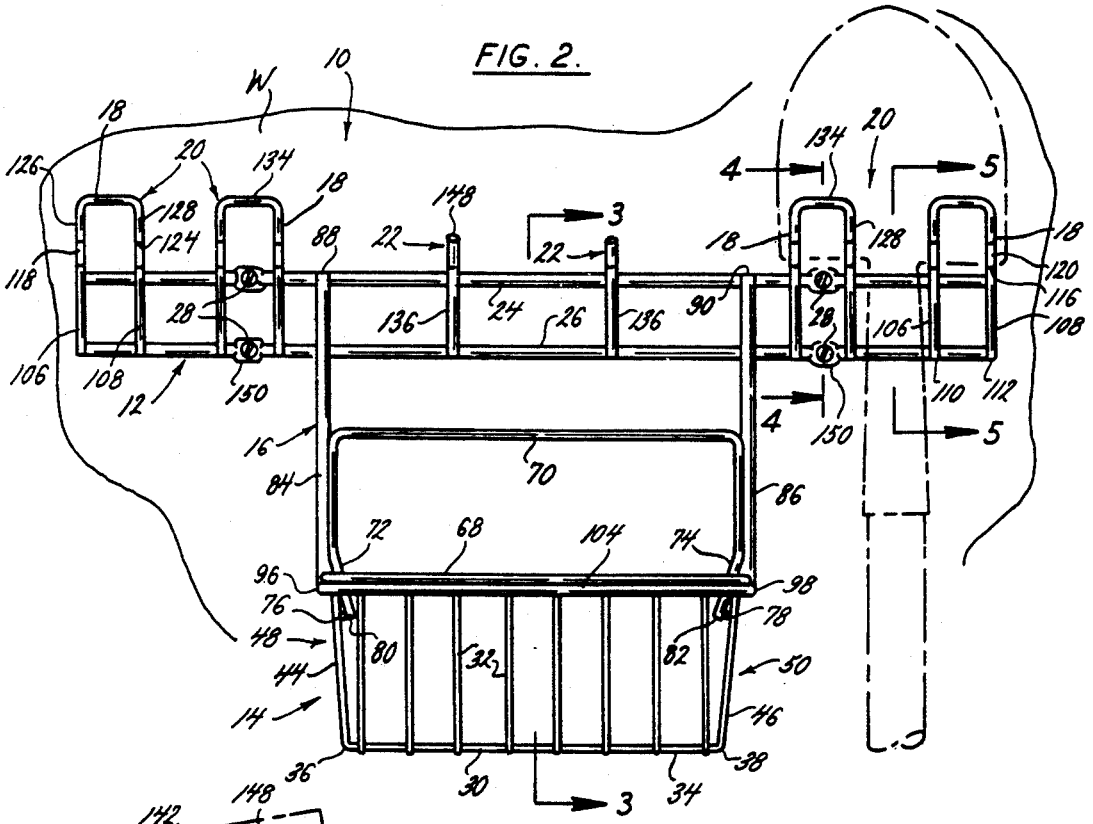
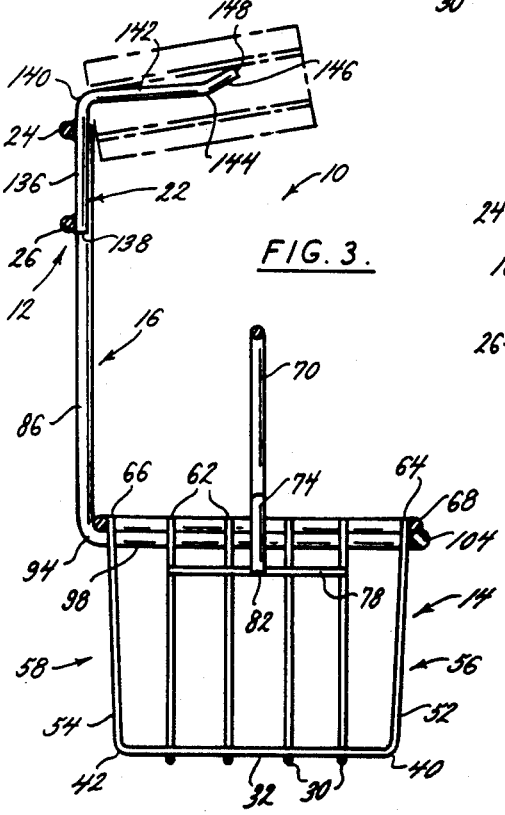
FIG. 3.
FIG. 5.
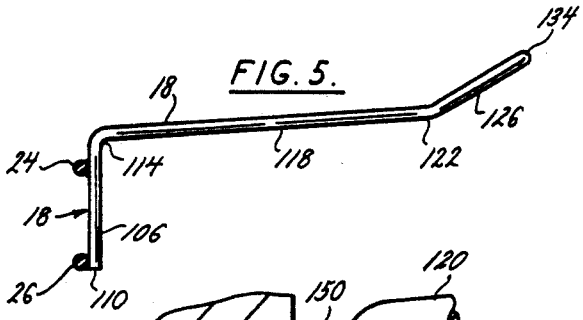
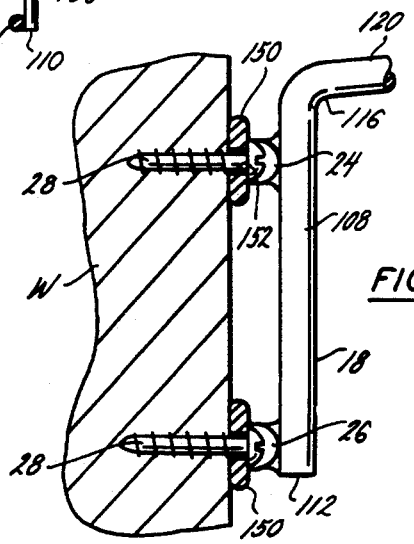
FIG. 4.

GARDEN EQUIPMENT SUPPORT RACK

BACKGROUND AND SUMMARY OF THE INVENTION

The present invention relates to a garden equipment support rack and particularly to a garden equipment support rack for mounting to a wall and for removably supporting a basket and one or several garden tools.

Garden tool brackets are well-known in the art. Typically they are formed from a pair of horizontally spaced side rails or rods which project forwardly from where they are supported by a wall. The side rails define a forwardly opening slot. The handle of a garden tool will fit in the slot between the side railes, retained by the wider functioning end, such as of a rake or hoe or other tool.

This garden equipment support rack is an improvement over the garden tool brackets of the prior art. Advantages of the present invention include a removable basket in combination with a fixed frame, both of which are made of metal wire elements welded together. The fixed frame has a basket support rack for removably supporting a basket and has two garden tool support assemblies for removably supporting one or more garden tools. In addition, this fixed frame has an overall configuration which permits it to generally nest with other like fixed frames. This nestability permits compact packaging for reduced shipping costs and permits a greater number of the fixed frames to be stocked on store display shelves and in inventory storage locations.

Therefore, this garden equipment support rack is an improvement on the garden tool brackets of the prior art since it is provided with a convenient to use removable basket, is made of rather inexpensive metal wire elements and is easily fabricated. Furthermore, this garden equipment support rack has a fixed frame which is generally nestable thereby costing little to ship as well as permitting greater numbers to be stocked in inventory and displayed at retail. These and more advantages are provided by the present invention without sacrificing appearance, strength or durability.

In accordance with the present invention, a garden equipment support rack has a fixed frame in combination with a removable basket. The fixed frame has a single wire that is bent to form a basket support rack. The basket has a front, a back, and two opposite side walls. At the upper edges of the side walls there is a continuous peripheral wire that functions as a flange portion by which the basket is removably supported on the basket support rack. The basket is for containing an assortment of things like trowels, gardening gloves, small pots, packets of seed and fertilizer, and so on, and is easily freed from the basket support rack for transport. The fixed frame also has several more wire elements that are bent and arranged to form a pair of garden tool support assemblies, each of which can removably support one or more garden tools. The form of the fixed frame generally allows it to be nested with additional fixed frames. This nestability permits compact packaging for reduced shipping costs and permits a greater number of fixed frames to be stocked on store display shelves and in inventory storage locations.

BRIEF DESCRIPTION OF THE DRAWINGS

FIG. 1 is a top plan view of the garden equipment support rack of the present invention.

FIG. 2 is a front elevation view of the garden equipment support rack with sections of a shovel shown in broken lines to illustrate the removable support thereof FIG. 3 is a sectional view taken generally along the line 3—3 of FIG. 4 with a spool of twine shown in broken lines for illustrative purposes only.

FIG. 4 is an enlarged sectional view, with portions broken/away, taken generally along the line 4—4 of FIG. 3.

FIG. 5 is an enlarged sectional view taken generally along the line 5—5 of FIG. 3.

FIG. 6 is an enlarged sectional view, with portions broken away, taken generally along the line 6—6 of FIG. 1.

DESCRIPTION OF THE PREFERRED EMBODIMENT

This garden equipment support rack 10 includes a fixed frame 12 in combination with a removable basket 14. The fixed frame 12 generally comprises a single wire element bent as will be described to form a basket support rack 16, four identical wire elements 18 bent and arranged as will be described to form a pair of identical garden tool support assemblies 20, and a pair of identical wire elements bent as will be described to form support hooks 22. The basket support rack 16, the four wire elements 18 constituting the garden tool support assemblies 20 and the pair of support hooks 22 are all welded to a pair of upper and lower horizontal wire elements 24 and 26 that enable the resulting integral fixed frame 12 to be attached to a wall W, or like mounting structure, by screws 28, or like fasteners.

The basket 14 has a transverse set of spaced, parallel U-shaped wires 30 disposed transverse to and welded to a longitudinal set of spaced, parallel U-shaped wires 32, to define a basket bottom 34. The transverse wires 30 have bends 36 and 38 that define the left and right margins of the basket bottom 34. Likewise, the longitudinal wires 32 have bends 40 and 42 that define the front and rear margins of the basket bottom 34. There are left and right arms 44 and 46 of the transverse wires 30 that extend generally upwardly from the first pair of opposite bends 36 and 38, and define left and right side walls 48 and 50. Similarly, there are front and back arms 52 and 54 of the longitudinal wires 32 that extend generally upwardly from the second pair of opposite bends 40 and 42, and define front and back walls 56 and 58. The left and right arms 44 and 46 diverge a little outwardly and have terminal upper ends 60 and 62. Likewise, the front and back arms 52 and 54 diverge a little outwardly and have terminal upper ends 64 and 66. A flange element 68, consisting of a single continuous wire, extends outwardly from and is welded to the outer surfaces of the upper ends 60, 62, 64 and 66 of all four basket walls. This flange element 68 is for stabilizing and maintaining the spans between adjacent basket wires 30 and/or 32, as well as between opposite basket walls. In addition, the flange element 68 has surface portions which define bearing surfaces for engagement with the basket support rack wire element 16, as described hereinafter.

An inverted U-shaped basket handle 70 extends upwardly from about the mid-point of the left and right side walls 48 and 50 (See FIG. 3). The handle 70 has a pair of inwardly tapering, lower segments 72 and 74, each of which lies on the inner surface of and is welded to the flange element 68 as generally illustrated in FIG. 2. A pair of short wire elements 76 and 78 are disposed on the inside surfaces of four transverse wires 30 of the basket 14 in a generally parallel and spaced relationship with the flange element 68, as generally illustrated in FIGS. 2 and 3, and at these places all are welded together. The inwardly tapering lower segments 72 and 74 of the basket handle 70 have terminal downward ends 80 and 82, and these downward ends 80 and 82 are disposed on the inner surfaces of and welded to the short wire elements 76 and 78, as generally illustrated in FIG. 2, in order to improve the strength of the connection between the basket 14 and the handle 70.

The wire element 16 that defines the basket support rack includes a pair of horizontally spaced, vertical segments 84 and 86, which have upper terminal ends 88 and 90 and lower bent ends 92 and 94 (See FIG. 2). The vertical segments 84 and 86 cross the upper and lower horizontal wire elements 24 and 26 as illustrated in FIG. 2, and at these places all are welded together. In addition, the wire element 16 has a pair of horizontally spaced, generally parallel side segments 96 and 98 that extend forwardly from and have rearward ends joined to the lower bent ends 92 and 94, and have forward bent ends 100 and 102. Finally, the wire element 16 has a front segment 104 that extends between and has opposite ends joined to the forward bent ends 100 and 102. These three horizontal segments 96, 98 and 104 of the wire element 16 cooperate to define a loop frame upon which the basket flange element 68 can supported, as generally illustrated in FIGS. 3 and 6. The transverse span of the flange element 68 is greater than the span between the vertical segments 84 and 86, and so the vertical segments 84 and 86 act as rearward stops that hold the front transverse span of the flange element 64 on top of the front wire segment 104.

The basket support rack 16 is configured to removably support the basket 14. To facilitate this, the side walls 48, 50, 56 and 58 of the basket are tapered, and the front segment 104 and side segments 96 and 98 of the basket support rack 16 define an opening sized to permit those portions of the basket 14 which are below the flange element 68 to pass therethrough.

Each of the four identical wire elements 18, which when combined in pairs define two garden tool support assemblies 20, generally includes a pair of horizontally spaced, generally parallel and vertical segments 106 and 108, which have terminal lower ends 110 and 112 and bent upper ends 114 and 116. The vertical segments 106 and 108 are disposed on the upper and lower horizontal wire elements 24 and 26 as generally illustrated in FIG. 2, and at these places all are welded together. In addition, each wire element 18 has a pair of horizontally spaced, parallel and forwardly projecting segments 118 and 120, which extend forwardly and a little upwardly from and have rearward ends joined to the bent upper ends 114 and 116, and have forward bent ends 122 and 124. A pair of horizontally spaced, parallel and retainer segments 126 and 128 extend forwardly and little more upwardly from and have rearward ends joined to the bent upper ends 122 and 124, and have forward bent ends 130 and 132. Finally, each wire element 18 has a transverse segment 134 which extends between and has opposite ends joined to the forward bent ends 130 and 132.

As previously indicated, each wire element 18 is coordinately spaced with respect to one other wire element 18 to define a garden tool support assembly 20. To constitute one garden tool support assembly 20, the horizontally spaced, parallel and generally horizontal segments 118 and 120, 126 and 128 of two wire elements 18 cooperatively provide surface portions upon which the lower outside margins of garden tool implements can be removably and uprightly supported (albeit upside down in some instances), as is generally illustrated by a shovel in FIG. 2. The horizontal spacing between the two wire segments 18 defines a forwardly opening slot, and this slot permits the removable passage of garden tool handles. In addition, these forwardly projecting segments 118 and 120, 126 and 128 have enough length to permit a plurality of garden tools to be removably supported on each garden tool support assembly 20. The forward segments 126 and 128 serve as tool retainers.

Each wire element 22 that defines a support hook generally includes a single vertical segment 136 that has a terminal lower end 138 and a bent upper end 140. The vertical segments 136 of wire elements 22 are disposed on the upper and lower horizontal wire elements 24 and 26 as generally illustrated in FIG. 2, and at these places all are welded together. In addition, each wire element 22 has a segment 142 which extends forwardly and a little upwardly from and has a rearward end joined to the bent upper end 140, and has a forward bent end 144. A retainer segment 146 extends forwardly and a little more upwardly from and has a rearward end joined to the bent upper end 144, and has a forward terminal end 148. These support hooks defined by wire elements 22 have multiple utility including for instance the removable support of a spool of twine, as generally illustrated in FIG. 3, and the like.

The upper and lower wire elements 24 and 26 are vertically spaced and are generally parallel with one another. The upper and lower wire element 24 and 26 are each formed with a pair of flat portions 150, and are provided with fastener holes 152 through each flat portion 150. The pair of fastener holes 152 of the upper wire 24 are vertically aligned with the pair of fastener holes 152 of the lower wire 26. In addition, these vertically aligned pair of fastener holes 152 of the upper and lower wire elements 24 and 26 are disposed on the wire elements 24 and 26 with about sixteen (16) inches between centers. Thus, the fastener holes 152 are so horizontally spaced as to permit the location of screws 28 on standard wall studs (not shown). The upper and lower wire elements 24 and 26 extend between and are welded to the vertical segments 84 and 86 of the wire element 16, the vertical segments 106 and 108 of each wire element 18, and the vertical segment 136 of each wire element 22, as illustrated in FIG. 2.

The fixed frame 12 is generally nestable with like fixed frames 12. More particularly the fixed frame 12 is generally nestable whereby in a nested stack of fixed frames 12 the fixed frames 12 are alternately and transversely offset from one another. This general nestability is possible in part because the segments 118 and 120, 126 and 128 of each wire element 18 as well as the segments 142 and 146 of each support hook 22 diverge from the segments 96 and 98 of the basket support rack 16. This is also possible because the forwardly opening slot between adjacent wire elements 18 of each garden tool support assembly 20 is wide enough to permit the removable passage of any one of the uniformly wide wire elements 18. Consequently, two like fixed frames 12 generally nest together when the transverse orientation of one is offset from the other. In larger numbers, these fixed frames 12 generally nest together best when the left and right edges of even numbered racks of a pile are coplanar in first planes, while the left and right edges of odd numbered fixed frames 12 of the pile are coplanar in second planes transversely offset from the first planes by the span across one slot. In accordance with that scheme, the fixed frame 12 of the garden equipment support rack 10 generally nests with other like racks 12 in close, vertically spaced relationships. This general nestability permits more compact packaging and thus saves shipping costs and permits a greater number of fixed frames 12 to be stocked in inventory and displayed on store shelves.

While the present invention has been described by reference to a specific embodiment, it should be understood that modifications and variations of the invention may be constructed without departing from the scope of the invention defined in the following claims.

What is claimed is:

1. A garden equipment support rack for attaching to the front face of a mounting structure and for removably and uprightly supporting tools of the type having an implement mounted on a handle, comprising:

a basket having a front, a back, two opposite side walls and having flange portions which extend outwardly from and have inner edges joined to the side walls, and a fixed frame for attaching to the mounting structure and for removably supporting the basket, said fixed frame comprising:

first means for removably supporting said basket by the flange portions;

second means for removably and uprightly supporting a plurality of said tools;

third means for attaching to the mounting structure and for securely supporting the first and second means.

2. The garden equipment support rack of claim 1 wherein the first means comprises at least a pair of horizontally spaced, generally horizontal members;

said generally horizontal members extend forwardly from and have rearward ends securely supported by said third means, and have forward ends;

said generally horizontal members providing surface portions upon which said flange portions can be supported.

3. The garden equipment support rack of claim 2 wherein the first means further comprises a cross member; and said cross member extends between and has opposite ends joined to said forward ends; wherein said cross member and generally horizontal members define an opening which is sized to permit those portions of the basket below said flange portions to pass therethrough.

4. The garden equipment support rack of claim 3 wherein the basket has tapered sides to facilitate passage through the opening.

5. The garden equipment support rack of claim 4 wherein the first means comprises a single metal wire.

6. The garden equipment support rack of claim 5 wherein the third means is metallic and securely supports said first means by means of welded joints.

7. The garden equipment support rack of claim 1 wherein the second means comprises at least one pair of horizontally spaced first members; and said first members extend generally forwardly from and have back ends securely supported by said third means and have front ends; wherein said pair of first members define a forwardly opening slot.

8. The garden equipment support rack of claim 7 wherein said first members provide surface portions upon which the lower outside margins of the implements of the tools can be removably supported, and said slot permits the removable passage of the tool handles.

9. The garden equipment support rack of claim 8 wherein said fixed frame is generally nestable with other like fixed frames in close, vertically spaced relationships.

10. The garden equipment support rack of claim 9 wherein the second means comprises metal wire elements.

11. The garden equipment support rack of claim 10 wherein the third means is metallic and securely supports the second means by means of welded joints.

12. The garden equipment support rack of claim 11 wherein the second means comprises two pair of horizontally spaced first members; wherein said two pair of first members are disposed on the third means on opposite sides of the first means.

13. The garden equipment support rack of claim 12 wherein the first means comprises metal wire elements and said third means securely supports said first means by means of welded joints.

14. The garden equipment support rack of claim 13 wherein the third means comprises at least one horizontal metal wire segment, and said segment is provided with fastener holes.

15. The garden equipment support rack of claim 14 wherein said fastener holes are spaced apart with about 16 inches between centers.

16. The garden equipment support rack of claim 1 wherein said basket comprises criss-crossed wire elements welded together.

17. The garden equipment support rack of claim 16 wherein the basket walls are inclined.

18. The garden equipment support rack of claim 17 wherein the basket side walls have upper edges, and the inner edges of said flange portions are joined to the side walls along said upper edges.

* * * * *